United States Patent [19]

Bergs

[11] Patent Number: 4,633,546

[45] Date of Patent: Jan. 6, 1987

[54] RESILIENT HINGE

[75] Inventor: Franciscus H. Bergs, Maastricht, Netherlands

[73] Assignee: Wagemans Mastricht B.V., Netherlands

[21] Appl. No.: 712,559

[22] Filed: Mar. 15, 1985

[30] Foreign Application Priority Data

Mar. 16, 1984 [NL] Netherlands ..... 8400855

[51] Int. Cl.[4] ..... A47B 95/00

[52] U.S. Cl. ..... 16/277; 16/250; 297/285

[58] Field of Search ..... 16/225, 254, 255, 257, 16/261–263, 221, 223, 250, 251, 277, 280, 286, 292, 297, 319; 297/300, 306, 285

[56] References Cited

U.S. PATENT DOCUMENTS 1,268,104 6/1918 Flick et al. ..... 16/250

FOREIGN PATENT DOCUMENTS 7908756 6/1980 Netherlands .
2031275 4/1980 United Kingdom ..... 297/306
2038174 7/1980 United Kingdom ..... 297/300

*Primary Examiner*—Donald R. Schran
*Assistant Examiner*—James L. Wolfe

[57] ABSTRACT

A resilient hinge comprising a first support that can be mounted on a member to be supported, such as the back of a chair, and a second support that can be mounted on a main body, such as the remainder of a chair, wherein the two supports are each connected hingedly to a hood and wherein between each support and the hood two bodies of elastic, resilient material are arranged.

7 Claims, 6 Drawing Figures

RESILIENT HINGE

The present invention relates to a resilient hinge comprising a first support that can be mounted on a member to be supported, such as the back of a chair, and a second support that can be mounted on a main body, such as the remainder of a chair, wherein said two supports are each connected hingedly to a hood and wherein between each support and the hood two bodies of elastic, resilient material are arranged.

The invented hinge is preferably characterized in that the bodies of both supports are shaped similarly, with a centrally arranged passage for a hinge shaft and two end sections, each backed up by the pertaining body of elastic, resilient material.

Moreover the invented hinge can be characterized in that the hood has raised edges comprising bearing holes for the hinge shaft.

Furthermore the invented hinge can be characterized in that the hood comprises an elevated central portion with a tunnel therethrough for receiving the hinge shaft, said shaft extending through the passage in at least one of the two supports.

The invented hinge can also be characterized in the the hood comprises elongated recesses at both sides of the hinge shaft, wherein each recess receives one of the two elastic bodies.

The invention will be elucidated further in the following description of a preferred embodiment of the invented resilient hinge, said preferred embodiment being illustrated in the drawing.

Figure 2:
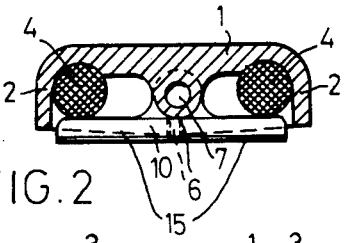
FIG. 2 is a cross-section through the hinge according to FIG. 1, said cross-section being perpendicular to the face of the drawing of FIG. 1 along the line II—II.
Figure 3:
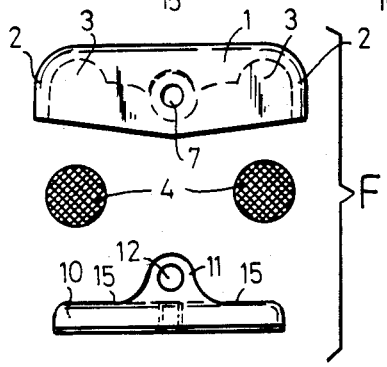
FIG. 3 is a cross-section according to FIG. 2, but in which the hood, the two elastic bodies and a support (both supports being the same) are indicated in their disassembled condition.
Figure 4:
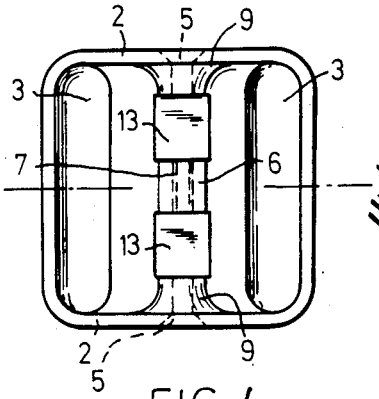
FIG. 4 is a view at the lower side of the hood.

The invented resilient hinge connection comprises a hood 1 that is cup-shaped by the raised edges 2, as shown in FIGS. 2 and 3. In FIGS. 2, 3 and 4 the bottom of the cup-shaped hood comprises two recesses 3 which receive portions of two elongated bodies 4 of elastic, resilient material. In each one of two opposed edges 2 of the hood 1 a hole 5 is provided, so that a hinge shaft 8 can be put therein.

Figure 1:
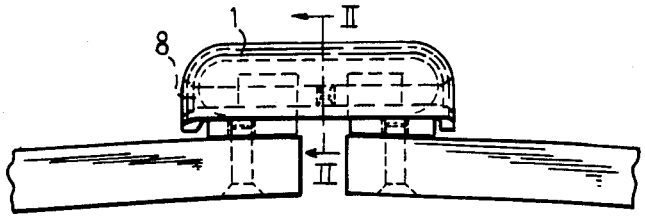
FIG. 1 is a side view of the resilient hinge, mounted on the one hand on the back of a chair, and on the other hand on parts of the remainder of said chair.

As shown in FIG. 4 an elevated portion 6 is provided centrally in the cup-shaped hood 1, said elevated portion comprising a tunnel 7 that is aligned with the holes 5, so that a hinge shaft 8 can be put in each hole 5 and a part of the tunnel 7, as is shown in FIG. 1. The edge 2 of the hood 1 near each hole 5 is preferably thickened so as to form the thickened edge 9 in which the hole 5 extends, so that each of the two hinge shafts 8 is firmly journaled in the thickened edge 9 and in a part of the tunnel 7 in the elevated portion 6 of the hood 1.

Instead of two hinge shafts 8 as shown in FIG. 1 it is also possible to use a single hinge shaft, extending from the one hole 5 to the other hole 5 of the hood.

Figure 5:
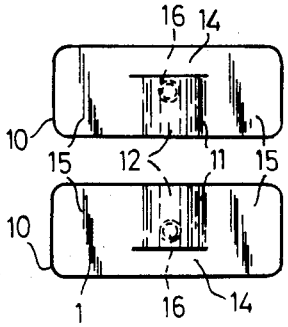
FIG. 5 is a view of the upper side of the two supports.

Furthermore the hinge comprises two preferably equally shaped supports 10 each provided, as shown in FIGS. 3 and 5, with a centrally located bulge 11 having a passage 12 for the hinge shaft 8. By putting the hinge shaft 8 through a hole 5 in the edge 2 (and its thickened section 9) of the hood 1, the passage 12 in the respective support 10 and in a part of the tunnel 7 in the elevated portion 6 of the hood 1, the respective support 10 is hingedly secured on the hood 1 by means of the hinge shaft 8. Then the bulge 11 of the respective support 10 extends into the space 13 between the elevated portion 6 and the thickened edge 9 of the hood 1 as shown in FIG. 4, and a flat portion 14 of each support, aligned with the bulge 11 and shown in FIG. 5, serves to receive the thickened section 9 of the edge 2 of the hood 1.

Figure 6:
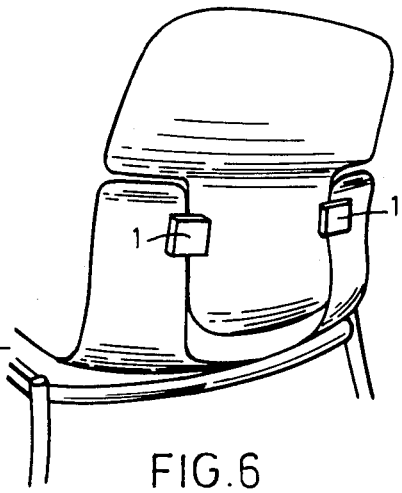
FIG. 6 shows the invented hinge when applied to a chair.

As shown in FIGS. 3 and 5 each support 10 comprises two thinner sections 15, and as shown in FIG. 2 said thin sections each support the pertaining portion of the elastic bodies 4 in the event that supports 10 are secured to the hood 1. As shown in FIGS. 3 and 5 each support 10 comprises a hole 16 with screw-thread for receiving a screw bolt by which the one support can be bolted on for instance a back of a chair as shown in FIGS. 1 and 6, and by which the other support 10 can be bolted on parts of the remainder of the chair. Instead of the central hole 16 in each support 10, a hole for a securing bolt can be provided in any one of the two thin sections 15 of each support 10.

Each resilient body 4 is preferably in the shape of a rod with circular cross-section, as illustrated in FIGS. 2, 3 and 4. Each resilient body 4 is made of elastic, resilient material.

As shown in FIGS. 1 and 6 the resilient hinge can be secured with the one support 10 to for instance the back of a chair and with the other support 10 it can be secured to parts of the remainder of the chair, so that the back of the chair is resiliently and restricted pivotably secured to the remainder of the chair so that said chair is more comfortable than a chair with a back that is immovable with respect to the remainder of the chair.

By way of example the two elastic bodies 4 can be made of hard polyurethane and they can have a diameter of 9.5 mm. The distance between the deepest portions of the recesses 3 of the hood 1 and the thin sections 15 of the supports 10 in the normal position can be 9 mm, so that the bodies 4 are pressed over 0.5 mm already, without the supports 10 being pivoted. The supports 10 can be pivoted at about 15° in both directions from their normal position against the elastic resilience of the bodies 4.

I claim:

1. A resilient hinge comprising a first support that can be mounted on a member to be supported, such as a back of a chair having a remainder, a second support that can be mounted on a main body, such as said remainder of said chair, a hinge shaft rotatably connecting said first and second supports about a hinge axis, said first and second supports each having first and second supporting portions on both sides of said shaft, a hood rotatably mounted about said hinge axis, said hood having hood portions facing and spaced from said supporting portions, wherein the hood has depending edges having bearing holes for said hinge shaft, and wherein the hood comprises an elevated central portion with a tunnel therethrough for receiving said hinge shaft, said shaft extending through the passage in at least one of the two supports and bodies of elastic, resilient material between said hood portions and said first and second supporting portions to resiliently resist rotation of said first and second supports with respect to each other in both directions.

2. A hinge according to claim 1, wherein both said supports have bodies that are shaped similarly, and each comprise a centrally arranged passage for said hinge shaft, and wherein said first and second supporting portions comprise two end sections.

3. A hinge according to claim 2, wherein the hood has depending edges having bearing holes for the hinge shaft.

4. A hinge according to claim 1, wherein the hood has depending edges having bearing holes for said hinge shaft.

5. A hinge according to claim 1, 2, or 4 wherein the hood comprises elongated recesses at both sides of the large shaft, and wherein each recess receives one of the two elastic bodies, and wherein each elastic body is made of hard polyurethane.

6. A hinge according to claim 1, 2, 4 or 3, wherein the hood comprises elongated recesses at both sides of the hinge shaft, and wherein each recess receives one of two elastic bodies.

7. A hinge according to claim 1, 2, 4 or 3, wherein each elastic body is made of hard polyurethane.

* * * * *